US009754565B2

(12) United States Patent
Warburton

(10) Patent No.: US 9,754,565 B2
(45) Date of Patent: Sep. 5, 2017

(54) SAXOPHONE NECK SYSTEM

(71) Applicant: Warburton Industries Inc., Mims, FL (US)

(72) Inventor: Ardean Terrance Warburton, Oviedo, FL (US)

(73) Assignee: Warburton Industries Inc., Mims, FL (US)

( * ) Notice: Subject to any disclaimer, the term of this patent is extended or adjusted under 35 U.S.C. 154(b) by 377 days.

(21) Appl. No.: 13/959,405

(22) Filed: Aug. 5, 2013

(65) Prior Publication Data

US 2013/0312584 A1 Nov. 28, 2013

Related U.S. Application Data

(63) Continuation of application No. 12/724,829, filed on Mar. 16, 2010, now Pat. No. 8,502,054.

(60) Provisional application No. 61/160,474, filed on Mar. 16, 2009.

(51) Int. Cl.
*G10D 9/00* (2006.01)
*G10D 7/08* (2006.01)

(52) U.S. Cl.
CPC ..... *G10D 9/00* (2013.01); *G10D 7/08* (2013.01); *Y10T 29/49574* (2015.01)

(58) Field of Classification Search
USPC ..... 84/385 R
See application file for complete search history.

(56) References Cited

U.S. PATENT DOCUMENTS 1,374,758 A * 4/1921 Nenneker ..... G10D 9/005 84/386
1,736,880 A * 11/1929 Gulick ..... G10D 9/005 84/386
1,867,481 A * 7/1932 Todt ..... G10D 9/005 84/386
1,870,211 A * 8/1932 Smith ..... 84/386
2,061,928 A * 11/1936 Albrecht ..... 84/385 R
3,776,090 A 12/1973 Ihara
5,249,499 A 10/1993 Goldstein et al.
5,456,152 A * 10/1995 Cusack et al. ..... 84/383 R
6,054,644 A 4/2000 Allen et al.
8,502,054 B2 8/2013 Warburton
(Continued)

OTHER PUBLICATIONS

U.S. Appl. No. 12/724,829, Final Office Action mailed Sep. 27, 2012, 14 pgs.
(Continued)

*Primary Examiner* — Christopher Uhlir
(74) *Attorney, Agent, or Firm* — Schwegman Lundberg & Woessner, P.A.

(57) ABSTRACT

A saxophone neck system uses interchangeable component parts to modify and optimize sound and resistance. The saxophone neck system may allow a saxophone player the ability to change components to achieve variations in sound and to use the components with various manufacturers' instruments and mouthpieces. With the use of various internal shapes and dimensions placed in a specific combination, the player can create a desired sound. Additionally, the saxophone neck system may eliminate neck cork compression discrepancies from different manufacturers by offering different diameters of the body of the initiator portion of the saxophone neck system to fit any saxophone mouthpiece.

20 Claims, 4 Drawing Sheets

(56) References Cited

U.S. PATENT DOCUMENTS

| | | | |
|---|---|---|---|
| 2008/0202314 | A1 | 8/2008 | Thanyakij |
| 2010/0229709 | A1 | 9/2010 | Warburton |

OTHER PUBLICATIONS

U.S. Appl. No. 12/724,829, Non Final Office Action mailed Sep. 1, 2011, 16 pgs.
U.S. Appl. No. 12/724,829, Notice of Allowance mailed Apr. 8, 2013, 11 pgs.
U.S. Appl. No. 12/724,829, Response filed Mar. 27, 2013 to Final Office Action mailed Sep. 27, 2012, 7 pgs.
U.S. Appl. No. 12/724,829, Response filed Apr. 30, 2012 to Non Final Office Action mailed Sep. 1, 2011, 13 pgs.

* cited by examiner

SAXOPHONE NECK SYSTEM

This application claims the benefit of priority to U.S. application Ser. No. 12/724,829, filed Mar. 16, 2010, which claims the benefit of priority to U.S. Provisional Application Ser. No. 61/160,474, filed Mar. 16, 2009, which applications are incorporated herein by reference in their entirety.

BACKGROUND OF THE INVENTION

The present invention relates to musical devices and, more particularly, to a saxophone neck system.

Saxophones utilize neckpieces to form the interface between the reed-carrying mouthpiece and the body of the saxophone. Current saxophone necks are formed as a single assembly, with no configurable or interchangeable components. This is disadvantageous to the player, as the specific neck configuration of a saxophone often has a significant effect on the playing and/or sonic characteristics of the instrument. These effects are due to the configuration of the neck, including the size and configuration of the various tapers of the internal bore within the neck. Even if a player finds a neck that provides the characteristics she wants, that neck will often not always be compatible with saxophones from another manufacturer. Additionally, even on a single instrument, if the player were to want different characteristics for different playing environments, for example solo playing as opposed to jazz playing, the player may often need to find a different neck to use. Saxophone players are all too familiar with the trial-and-error method of purchasing and fitting traditional one-piece necks to their instruments while searching for a particular set of playing and sound qualities. Typically, saxophone players may find a one-piece neck that plays well enough and learn to like it.

As can be seen, there is a need for a saxophone neck that allows the player the ability to change components to achieve variations in sound and to use the components with various manufacturers' instruments and mouthpieces.

SUMMARY OF THE INVENTION

The present invention provides a saxophone neck system that provides a central neck component, with at least one adaptor component removably coupled thereto. Some preferred examples of the invention have two adaptor components, one configured to form that portion of the neck system that receives the mouthpiece (herein termed the "initiator"), and another configured to form that portion of the neck system that engages the saxophone body (herein, the "tenon"). In some examples of the inventive neck system, each adaptor component will be manually removable from and attachable to the central neck component. For clarity, the term "manually removable" as used herein means that there is a mechanical coupling that facilitates mechanical assembly and disassembly of the components either by hand or by hand-held equipment; and distinguishes, for example, essentially permanently-coupled components (such as brazed or soldered components). In the description of the present invention, the term "saxophone neck" (element 60, in FIG. 1) will be used to identify the central neck component, but should not be confused with the described prior art "saxophone neck" that is a single component extending between the mouthpiece and the instrument body.

In one aspect of the present invention, a saxophone neck system comprises a saxophone neck having a portion configured as a first part of a first releasable mechanical coupling mechanism; and a first adaptor component having a desired external and internal configuration, the first adaptor component further having a portion configured as a second part of the first releasable coupling mechanism; wherein the first adaptor component is adapted to releasably couple to the central neck component through use of the first and second parts of the first releasable coupling mechanism.

In another aspect of the present invention, a saxophone neck system comprises a saxophone neck; an initiator, the initiator having a first end adapted for removably connecting to a first end of the saxophone neck and the initiator having a second end adapted for attachment to a mouthpiece; and a tenon, the tenon having a first end adapted for removably connecting to a second end of the saxophone neck and the tenon having a second end adapted for attachment to a body of a saxophone, wherein the second end of the initiator has a plurality of o-rings therearound, the o-rings providing an airtight seal to a mouthpiece fitted around the second end of the initiator.

In a further aspect of the present invention, a method of manufacturing a saxophone neck assembly comprises forming a central neck component having a portion configured as a first part of a first releasable mechanical coupling mechanism; forming a first adaptor component having a desired external and internal configuration, the first adaptor component further having a portion configured as a second part of the first releasable coupling mechanism; and attaching the first adaptor component to the central neck component through use of the first and second parts of the first releasable coupling mechanism.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a saxophone neck system using interchangeable component parts to modify and optimize sound and resistance. The saxophone neck system according to an embodiment of the present invention may allow a saxophone player the ability to change components to achieve variations in sound and to use the components with various manufacturers' instruments and mouthpieces. With the use of various internal shapes and dimensions placed in a specific combination, the player can create the desired sound. Additionally, the saxophone neck system of the present invention may eliminate neck cork compression discrepancies from different manufacturers by offering different diameters of the body of the initiator portion of the saxophone neck system, each sized to fit a known size of saxophone mouthpiece.

Figure 1:
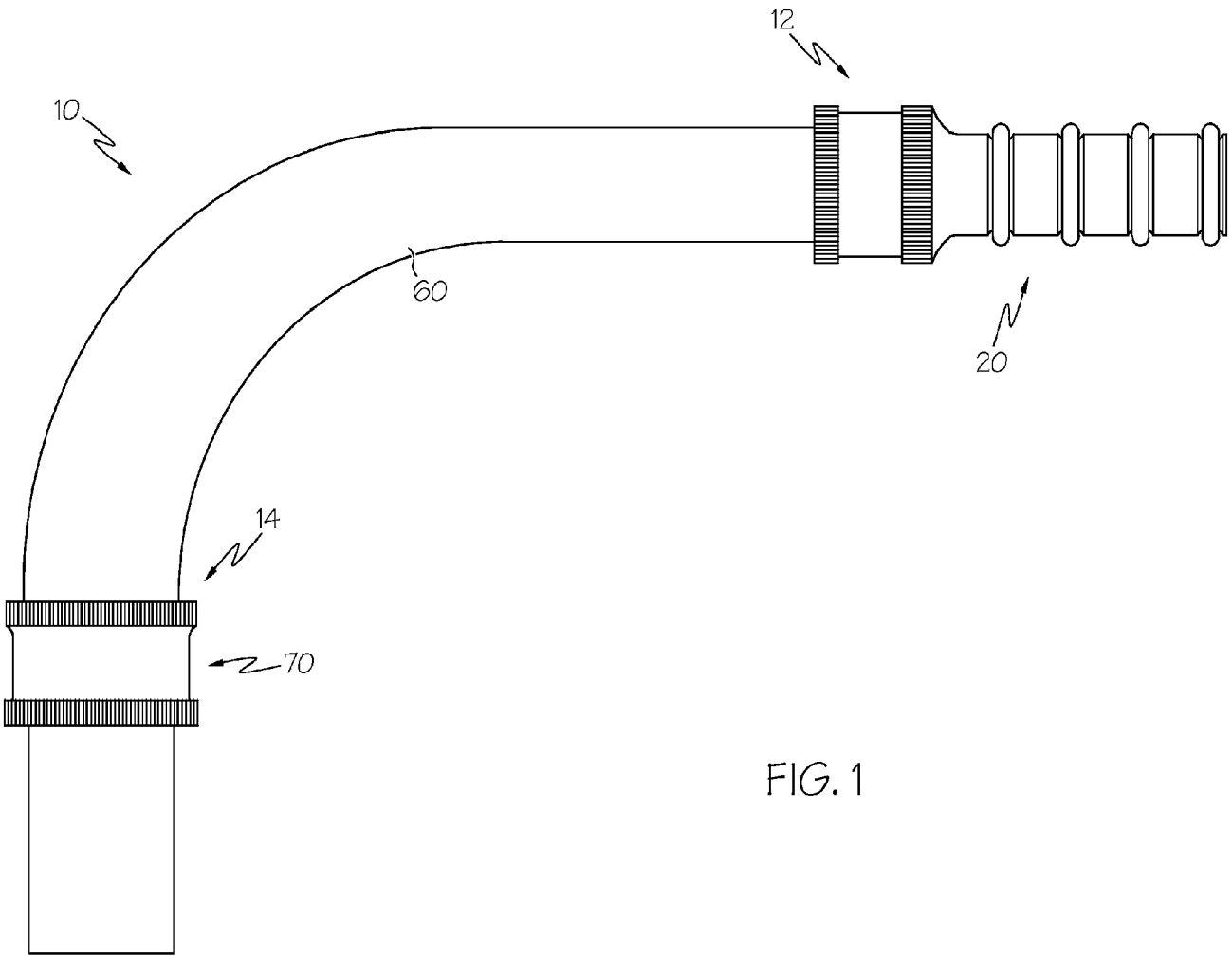
FIG. 1 is a side view of a saxophone neck system according to an embodiment of the present invention.
Figure 2:
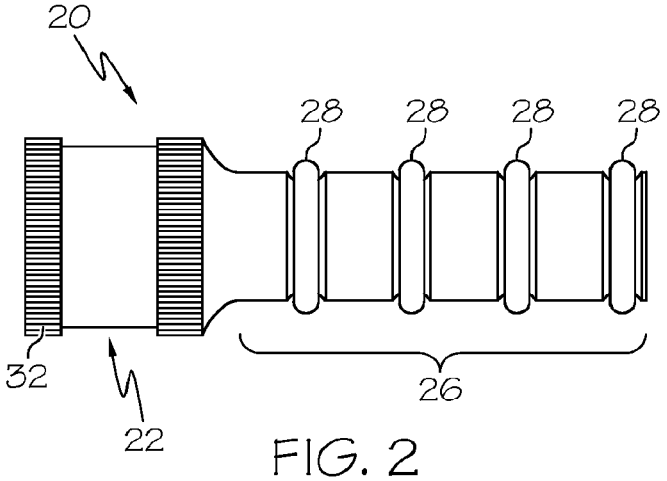
FIG. 2 is a side view of an initiator according to an embodiment of the present invention.
Figure 3:
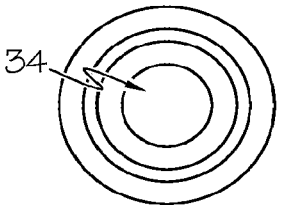
FIG. 3 is a front view of the initiator of FIG. 2.
Figure 4:
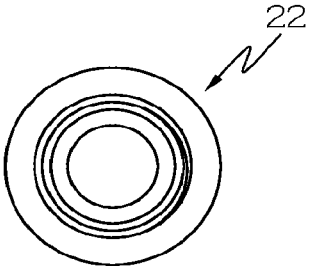
FIG. 4 is an end view of the initiator of FIG. 2.
Figure 5:
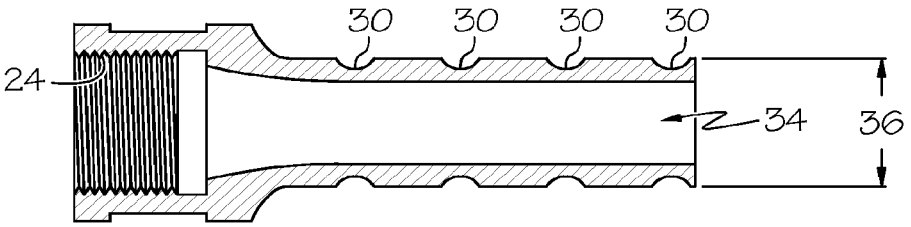
FIG. 5 is a cross-sectional side view of the initiator of FIG. 2.

Referring to FIG. 1, there is shown a saxophone neck system 10 having an initiator 20 attached to a first end 12 of a saxophone neck 60. A tenon 70 may be attached to a second end 14 of the saxophone neck 60.

The initiator 20 and the tenon 70 are each typically removably attached to the neck 60, typically through use of a manually releasable mechanical coupling, which may be of any desired configuration to achieve the necessary coupling. In the depicted example, the mechanical coupling is achieved through mating threads, but other coupling mechanisms might be used, such as, by way of example only, bayonet couplings, compression or friction couplings or adjustable interference couplings (such as a split sleeve, with a dimension controlled by an adjustment screw, as used on any saxophone bodies for engaging a conventional neck tenon). Any of these coupling mechanisms may include one or more sealing mechanisms, such as o-rings, gaskets, etc. to assure creation of an airtight coupling. In one possible embodiment the initiator 20 may include an initiator adapter section 22 having female threads 24. The female threads 24 may threadably engage with male threads 62 (FIG. 6) of the neck 60. The initiator adapter section 22 may include outer knurls 32 to assist in threading the initiator 20 on and off the neck 60.

The initiator 20 may include a mouthpiece attachment section 26 having a plurality of o-rings 28 positioned therearound. In one possible embodiment, about two to six o-rings 28, typically four o-rings 28, will be positioned around the mouthpiece attachment section 26 of the initiator 20. The o-rings may fit into channels 30 cut around the mouthpiece attachment section 26 of the initiator 20. A mouthpiece (not shown) will fit over and engage o-rings 28, replacing conventional cork mouthpiece attachment mechanisms. The mouthpiece attachment section 26 may have a diameter 36 that will fit into the user's mouthpiece in an airtight manner.

The initiator 20 may have an internal bore 34 that may be shaped to produce a certain sound and/or resistance. Typically, the shapes of the internal bore 34 may be formed to close tolerances with computerized numerical controlled (CNC) equipment. Exemplary shapes may include 1) tapered small to large (relative to the direction of air flow through the played saxophone), similar to conventional saxophone design; 2) tapered small to large (relative to air flow through the played saxophone) through the first half if the length, then arc-shaped; 3) cylindrical for the first third of the length, then arc shaped; 4) continuous arc shaped; 5) cylindrical for the first two-thirds of the length, then flared-shaped; 6) reverse taper large to small (relative to air flow through the played saxophone); and 7) straight cylinder.

Each of the above described tapers and arcs may have varying degrees of taper and arc. For example, a slight taper of about 1% (referring to a 1% change of inside diameter from end to end) could be used for any of the tapers described above. At another extreme, a large taper of about 50% may be used. The degree of taper may even vary over the length of the internal bore 34. For example, a small to large taper may start at a small 1% taper and may change at a midpoint to about 10% taper.

Each of the above described tapers and arcs may also have varying inside diameter bores. The bore diameter may be varied due to mouthpiece size, for example. The bore diameter may also be varied to provide different sounds and resistances for the saxophone player. In other words, each bore shape may have a number of different bore sizes.

Each combination of bore size and internal shape may provide different resistance levels and sound characteristics. A user may interchange various initiators 20 onto the same neck 60 to achieve different sounds and playing characteristics.

The initiator 20 (as well as neck 60, and tenon 70) may be made of brass, for example, which may be left bare (or "raw") or may have a protective and/or appearance-enhancing material applied thereto, such as, for example, a lacquer or epoxy coating, or a metallic plating, such as gold, nickel or silver. Other materials may be chosen for all or a portion of the initiator 20. For example, some (or all) of the initiator 20 may be made from plastic, cork or another desired material, so long as the described mechanical coupling can be formed from, or attached to, the material forming the remainder of the initiator 20.

Figure 6:
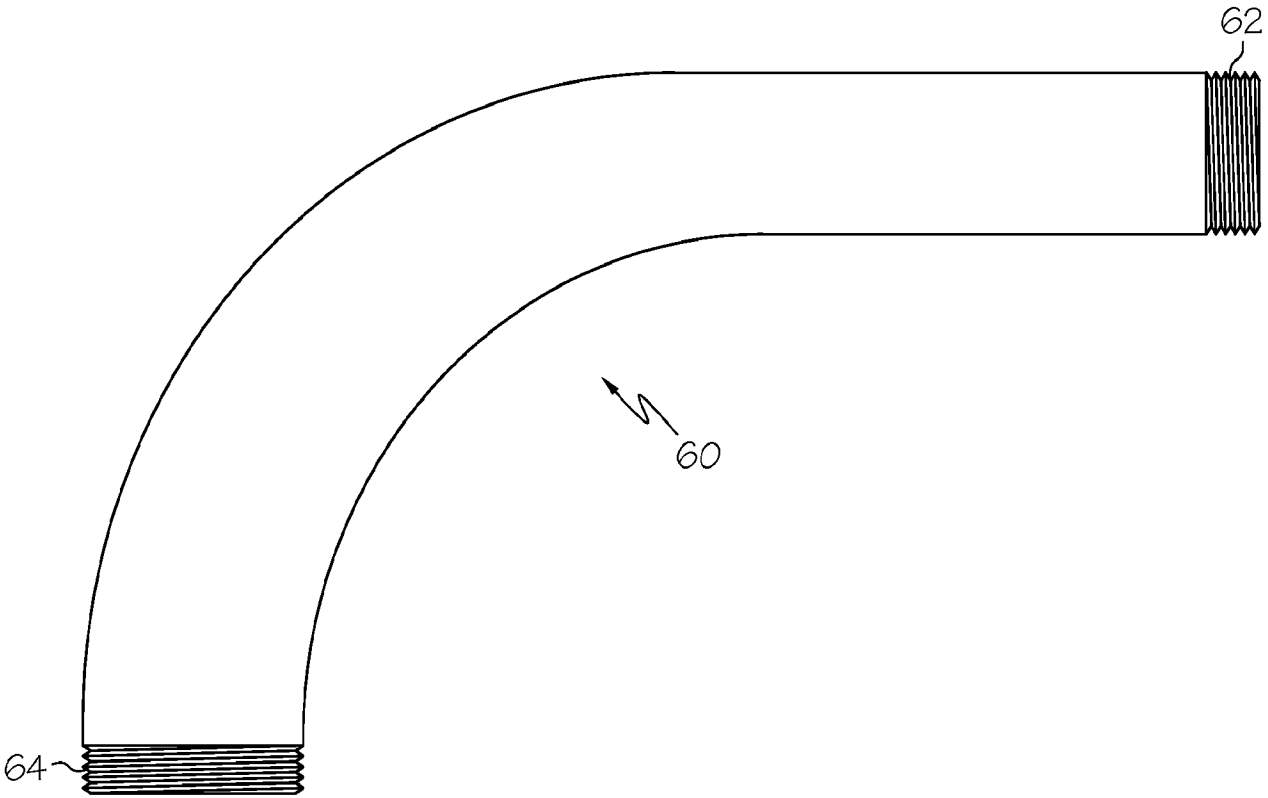
FIG. 6 is a side view of a saxophone neck according to an embodiment of the present invention.

Referring to FIG. 6, the neck 60 may include a first male threaded end 62 for attachment of the initiator 20 and a second male threaded end 64 for attachment of the tenon 70. The threaded ends 62, 64 may have, for example, a number forty thread pitch to assure an accurate mating to the initiator 20 and tenon 70, respectively. The neck 60 may include an octave key and octave hole (not shown) that may be designed and positioned similar to conventional saxophone necks. The neck 60 may be typically made of brass, but may also be made of plastic, wood or other materials. The neck 60 may be made by forming threads (such as by soldering, brazing, welding or the like) on each end of a user's original neck. Where the saxophone neck 60 is formed through use of a conventional prior art, one-piece neck, it will be apparent to those skilled in the art, that the prior art neck will have to be shortened to accommodate the described one or two mechanical couplings.

Figure 7:
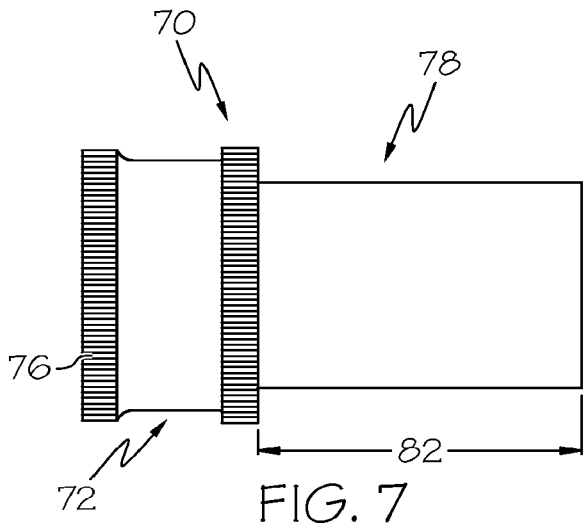
FIG. 7 is a side view of a tenon according to an embodiment of the present invention.
Figure 8:
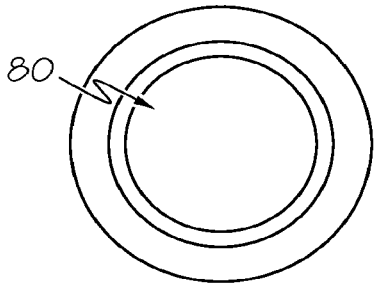
FIG. 8 is an end view of the tenon of FIG. 7.
Figure 9:
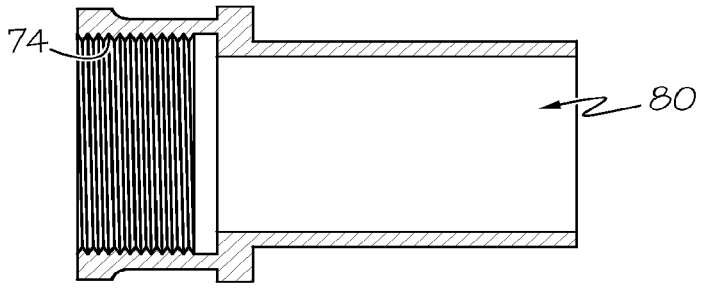
FIG. 9 is a cross-sectional side view of the tenon of FIG. 7.

Referring to FIGS. 7 through 9, the tenon 70 may include a tenon adapter section 72 that may have female threads 74 therewithin. The female threads 74 of the tenon adapter section 72 may threadably attach to the second end 64 of the neck 60. The tenon adapter section 72 may have exterior knurls 76 to assist in threading the tenon 70 on and off the neck 60. A tenon coupling section 78 may frictionally fit into the body of a saxophone (not shown).

An internal bore 80 of the tenon 70 may be formed with a taper from smaller to larger (relative to air flow through the played saxophone). Such a tapered tenon 70 may result in relatively continuous taper throughout the saxophone neck system 10. Alternatively, the internal bore 80 of the tenon 70 may be any shape, including independently selected from the bore shapes described above for the initiator 20. Further, as described above, a single bore shape may include a number of bore sizes.

The tenon coupling section 78 may be sized for any particular saxophone. The tenon 70 may be made of, for example, plated brass, and may be machined to the proper size, thereby reducing or eliminating misalignment problems associated with many commercial fittings between the saxophone neck and the body of the instrument.

As the saxophone player blows air into the mouthpiece, the selected initiator 20 may influence the air column and influence the sound and resistance characteristics as a result of the shape and size of the bore 34 through the initiator 20, and to a lesser extent through the configuration of the tenon. The initiator 20 may be attached by precision threads 24, 62 to the neck 60, which may transport air through the instrument. The saxophone neck 60 may be attached to the tenon 70. The size of the tenon 70 may be selected to allow a proper fit to any make and model of saxophone, thus achieving a universality for the saxophone neck system 10 according to an embodiment of the present invention. The tenon 70 may also be used to control resistance and sound through various diameters and length 82 thereof.

In an exemplary use situation, a saxophone player would try different models and styles of the initiator 20 and the tenon 70 attached to the saxophone neck 60. Ideally, as described earlier herein, the initiator and tenon will be relatively easily interchangeable on the neck to allow a player to try different combinations until finding the most satisfactory combinations for that player. These different models and styles of the initiator 20 and the tenon 70 may result in different sounds and tones. Players may choose different models for various types of musical styles. Thus the described neck system allows a customization of the saxophone neck configuration and properties in a novel and unique manner.

It should be understood, of course, that the foregoing relates to exemplary embodiments of the invention and that modifications may be made without departing from the spirit and scope of the invention as set forth in the following claims.

What is claimed is:

1. A saxophone neck system, comprising:

a saxophone neck component having a first portion configured as a first part of a first threaded coupling the saxophone neck component defining an internal air passage; and a first adaptor component having a desired external and internal configuration, the first adaptor component further having an integral first threaded portion configured as a second part of the first threaded coupling, the first adaptor component further having a second portion configured to engage a saxophone mouthpiece, the first adapter component defining an internal bore;

wherein the first threaded coupling is adapted to releasably secure the first adaptor component having said second portion to the saxophone neck component.

2. The saxophone neck system of claim 1, wherein the first adaptor component is an initiator including an initiator adapter section adapted for threadably coupling to a first end of the saxophone neck component, and the initiator further including a mouthpiece attachment section adapted for releasably coupling to the saxophone mouthpiece.

3. The saxophone neck system of claim 2, wherein the first end of the saxophone neck component has male threads and the initiator adapter section has mating female threads.

4. The saxophone neck system of claim 2, further comprising a plurality of o-rings on an external periphery of the mouthpiece attachment section.

5. The saxophone neck system of claim 4, further comprising a plurality of grooves cut in the mouthpiece attachment section of the initiator, wherein the o-rings fit into each of the plurality of grooves.

6. The saxophone neck system of claim 4, wherein the o-rings form an airtight seal between the initiator and a mouthpiece when attached thereto.

7. The saxophone neck system of claim 2, wherein the saxophone neck component includes a second portion configured as a first part of a second releasable mechanical coupling mechanism; and wherein the saxophone neck system further comprises:

a second adaptor component having a desired external and internal configuration, the second adaptor component further having a portion configured as a second part of the second releasable coupling mechanism;

wherein the second adaptor component is adapted to releasably couple to the saxophone neck component through use of the first and second parts of the second releasable coupling mechanism.

8. The saxophone neck system of claim 7, wherein the second adaptor component is adapted for releasably coupling to a saxophone body.

9. The saxophone neck system of claim 8, wherein the second end of the saxophone neck component has a first threaded portion and wherein the second adaptor component has a mating threaded portion.

10. The saxophone neck system of claim 9, wherein the second adaptor component has an internal bore that is tapered from smaller to larger relative to air flowing from the initiator, through the saxophone neck component and through the tenon.

11. The saxophone neck system of claim 2, wherein the initiator adapter section has external knurls.

12. The saxophone neck system of claim 9, wherein the second adapter component has external knurls.

13. The saxophone neck system of claim 8, wherein the tenon of the second adapter component is adapted to frictionally fit into a body of a saxophone.

14. The saxophone neck system of claim 2, wherein the initiator has an internal bore shape that, considered along its length in a direction passing from the mouthpiece attachment section to the initiator adaptor section, is one of the following configurations:

tapered small to large through a first portion of the length of the initiator, then arc-shaped through a second portion of the initiator;

cylindrical for a first portion of the length of the initiator, then arc-shaped through a second portion of the initiator;

continuously arc-shaped throughout the entire length of the initiator;

cylindrical for a majority of the length of the initiator, then arc-shaped for the remaining minority length of the initiator;

tapered large to small for at least some portion of the length of the initiator; and cylindrical for the entire length of the initiator.

15. A method of manufacturing a saxophone neck assembly, the method comprising the acts of:

forming a saxophone neck component having a portion configured as a first part of a first threaded coupling the saxophone neck component defining an internal air passage; and forming a first adaptor component having a desired external and internal configuration, the first adaptor component further having an integral first threaded portion configured as a second part of the first threaded coupling, the first adaptor component further having a second portion configured to engage a saxophone mouthpiece, the first threaded coupling configured to secure the adaptor component having said second portion to the saxophone neck component.

16. The method of claim 15, further comprising the acts of:

forming the saxophone neck component to have a portion configured as a first part of a second threaded coupling; and forming a second adaptor component having a desired external and internal configuration, the second adaptor component further having a portion configured as a second part of the second threaded coupling.

17. The method of claim 16, wherein the first adaptor component is an initiator configured to engage a saxophone mouthpiece, and wherein the initiator has an internal bore profile in which at least a portion of the internal bore profile has a shape that is not a linearly increasing bore.

18. The method of claim 16, wherein the second adaptor is further configured to engage a saxophone body.

19. The saxophone neck system of claim 1, wherein the internal bore of the first adaptor component defines a portion of the air path from the mouthpiece through the saxophone neck system.

20. The saxophone neck system of claim 1, wherein at least a portion of the internal bore of the first adaptor component has at least one of the following shapes in the direction of air flow through the first adaptor component: cylindrical, a decreasing taper from large to small, and an arcuate expansion.

* * * * *